US008646532B2

(12) United States Patent
Xu

(10) Patent No.: US 8,646,532 B2
(45) Date of Patent: Feb. 11, 2014

(54) VALVE, VALVING DEVICE AND METHOD

(75) Inventor: Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 355 days.

(21) Appl. No.: 12/780,484

(22) Filed: May 14, 2010

(65) Prior Publication Data

US 2011/0278016 A1 Nov. 17, 2011

(51) Int. Cl.
*E21B 34/08* (2006.01)

(52) U.S. Cl.
USPC ..... 166/321; 166/372

(58) Field of Classification Search
USPC ..... 166/386, 321, 319, 373, 374, 372, 375; 137/508, 155
See application file for complete search history.

(56) References Cited

U.S. PATENT DOCUMENTS

| | | | | |
|---|---|---|---|---|
| 1,687,317 | A | 10/1928 | Archer | |
| 1,723,993 | A | 8/1929 | Black | |
| 2,251,977 | A * | 8/1941 | Burt | 166/156 |
| 2,306,828 | A | 12/1942 | Mowrey | |
| 2,855,952 | A | 10/1958 | Tausch et al. | |
| 3,193,016 | A * | 7/1965 | Knox | 166/184 |
| 3,333,640 | A | 8/1967 | Garrett et al. | |
| 3,426,786 | A | 2/1969 | Canalizo | |
| 3,476,135 | A | 11/1969 | Canalizo | |
| 3,530,874 | A | 9/1970 | Lamb et al. | |
| 3,583,481 | A * | 6/1971 | Vernotzy | 166/184 |
| 3,595,315 | A | 7/1971 | Alley | |
| 3,659,961 | A | 5/1972 | Lamb et al. | |
| 3,779,263 | A * | 12/1973 | Edwards et al. | 137/68.25 |
| 4,014,386 | A | 3/1977 | Johnson et al. | |
| 4,100,969 | A | 7/1978 | Randermann, Jr. | |
| 4,162,691 | A | 7/1979 | Perkins | |
| 4,481,973 | A * | 11/1984 | O'Brien et al. | 137/469 |
| 4,513,944 | A | 4/1985 | Adams, Jr. | |
| 5,263,683 | A | 11/1993 | Wong | |
| 5,372,193 | A * | 12/1994 | French | 166/250.08 |
| 5,522,418 | A | 6/1996 | Johnson et al. | |
| 5,896,924 | A | 4/1999 | Carmody et al. | |
| 6,983,795 | B2 | 1/2006 | Zuklic et al. | |
| 2002/0189814 | A1 * | 12/2002 | Freiheit et al. | 166/373 |

FOREIGN PATENT DOCUMENTS

| | | |
|---|---|---|
| FR | 2626647 | 8/1989 |

OTHER PUBLICATIONS

Mark E.P. Dawson, Marshall N. Smith, Halliburton Energy Services, Inc. 'New Setting Technique for Gravel Pack Packers Increases Operational Safety and Reduces Costs' SPE Asia Pacific Oil and Gas Conference and Exhibition, Sep. 9-11, 2003, Jakarta, Indonesia; Paper No. 80451-MS; DOI: 10.2118/80451-MS.

(Continued)

*Primary Examiner* — William P Neuder
*Assistant Examiner* — Kipp Wallace
(74) *Attorney, Agent, or Firm* — Cantor Colburn LLP

(57) ABSTRACT

A valving device includes a tubular with a port and a sleeve slidably sealingly engaged with the tubular between a first position and a second position. The sleeve is configured to occlude the port when in the first position and uncover the port when in the second position. The valving device is configured such that pressure inside the tubular does not urge the sleeve toward the second position while pressure applied radially outwardly of the tubular and the sleeve urge the sleeve toward the second position.

12 Claims, 2 Drawing Sheets

(56) References Cited

OTHER PUBLICATIONS

A. Fitzgerald, G. Harpley, and J. Hupp, BP, and J.G. King, SPE, Baker Oil Tools "New High-Performance Completion Packer Selection and Deployment for Holstein and Mad Dog Deepwater Gulf of Mexico Projects" SPE Annual Technical Conference and Exhibition, Oct. 9-12, 2005, Dallas, Texas; Paper No. 95729-MS; DOI: 10.2118/95729-MS http://www.onepetro.org/mslib/app/Preview.do?paperNumber=SPE-95729-MS.

Victor J. Guatelli, Kevin R. Lay, Advanced Well Technologies "The Planning and Installation of a Hydraulically Operated (Intelligent) Completion—Offshore NW Australia" SPE Asia Pacific Oil and Gas Conference and Exhibition, Oct. 18-20, 2004, Perth, Australia; Paper No. 88507-MS; DOI: 10.2118/88507-MS.

James G. King, Baker Oil Tools "A Comparison of Interventionless Packer Setting Techniques and Enhanced Functionality Considerations" SPE Annual Technical Conference and Exhibition, Sep. 29-Oct. 2, 2002, San Antonio, Texas; Paper No. 77774-MS; DOI: 10.2118/77774-MS.

David R Larimore, Jeff Huggins, Ewan Robb, Willie Ching, D.W. Thomson, John Jennings, Halliburton Energy Services, Inc.; Terje Bach, Den Norske Stats Oljeselskap A/S (Statoil) Overcoming Completion Challenges with Interventionless Devices—Case Histories of The "Disappearing Plug" SPE Asia Pacific Oil and Gas Conference and Exhibition, Oct. 16-18, 2000, Brisbane, Australia; Paper No. 64527-MS; DOI: 10.2118/64527-MS.

Daniel L. Patterson, Halliburton Energy Services, Inc.; Ian D. Taggart, Shell UK Exploration and Production; Harald W. Breivik, Statoil Norway; Gordon Scott, Randy Simonds, Rod Falconer, Halliburton Energy Services, Inc. "Interventionless Production Packer Setting Technique Reduces Completion Costs" SPE Latin American and Caribbean Petroleum Engineering Conference, Mar. 25-28, 2001, Buenos Aires, Argentina; Paper No. 69619-MS; DOI: 10.2118/69619-MS.

Michael Tolan, BHP Petroleum; Maurice Boyle, WellDynamics International, Inc.; Glynn Williams, Sensa "The Use of Fiber-Optic Distributed Temperature Sensing and Remote Hydraulically Operated Interval Control Valves for the Management of Water Production in the Douglas Field" SPE Annual Technical Conference and Exhibition, Sep. 30-Oct. 3, 2001, New Orleans, Louisiana; Paper No. 71676-MS; DOI: 10.2118/71676-MS.

Notification of Transmittal of the International Search Report and the Written Opinion of the International Searching Authority; PCT US2011/032259; Korean Intellectual Property Office; mailed Dec. 14, 2011; 8 pages.

* cited by examiner

VALVE, VALVING DEVICE AND METHOD

BACKGROUND

Tubular systems include various valves for controlling fluid flow. A wide variety of mechanisms are employed to actuate these valves; electric motors, hydraulic systems, and longitudinal movements of complete tubular strings, are a few. Although, these various mechanisms function adequately, all have their advantages and disadvantages, which strongly influence the applications for which they are well suited. Operators of tubular systems are, therefore, always receptive to new valving devices and methods to add to their list of available tools.

BRIEF DESCRIPTION

Disclosed herein is a valving device including a tubular with a port and a sleeve slidably sealingly engaged with the tubular between a first position and a second position. The sleeve is configured to occlude the port when in the first position and uncover the port when in the second position. The valving device is configured such that pressure inside the tubular does not urge the sleeve toward the second position while pressure applied radially outwardly of the tubular and the sleeve urge the sleeve toward the second position.

Further disclosed is a valving method that includes slidably engaging a sleeve with a tubular having a port between a first position that occludes flow through the port and a second position that allows flow through the port. The valving method also includes failing to urge the sleeve toward the second position with pressure inside of the tubular, pressuring up an outside of the tubular and the sleeve, and urging the sleeve toward the second position with the pressuring up and moving the sleeve with the urging from the pressuring up to the second position.

Further disclosed is a valve including a tubular with at least one port, a sleeve slidably engaged with the tubular and is movable between a first position and a second position. The valve also includes, a first seal, a second seal and a third seal that are each sealable to both the tubular and the sleeve. The first seal and the second seal straddle the port thereby occluding flow through the at least one port when the sleeve is in the first position, and the first seal is nonsealingly engaged with one of the tubular and the sleeve when the sleeve is in the second position thereby permitting flow through the at least one port. The valve is configured to increase urging of the sleeve toward the second position in response to increases in pressure radially outwardly of the sleeve and the tubular and to not increase urging forces on the sleeve toward the second position in response to increases in pressure within the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
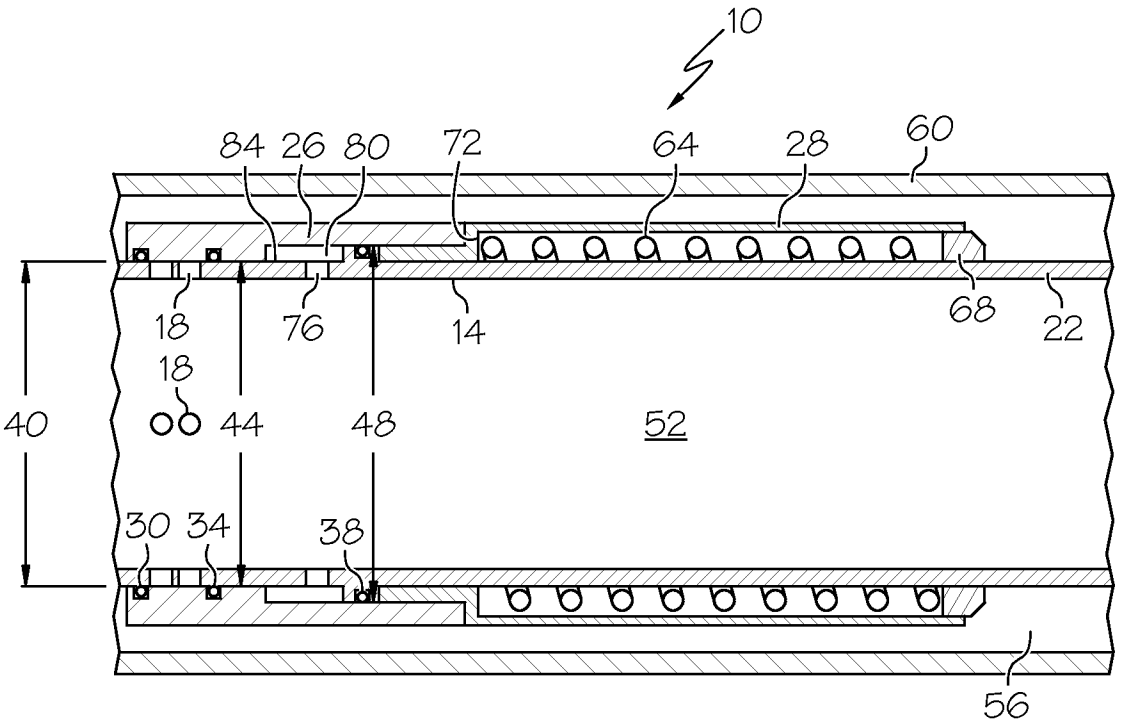
FIG. 1 depicts a cross sectional view of a valving device disclosed herein in a closed position.
Figure 2:
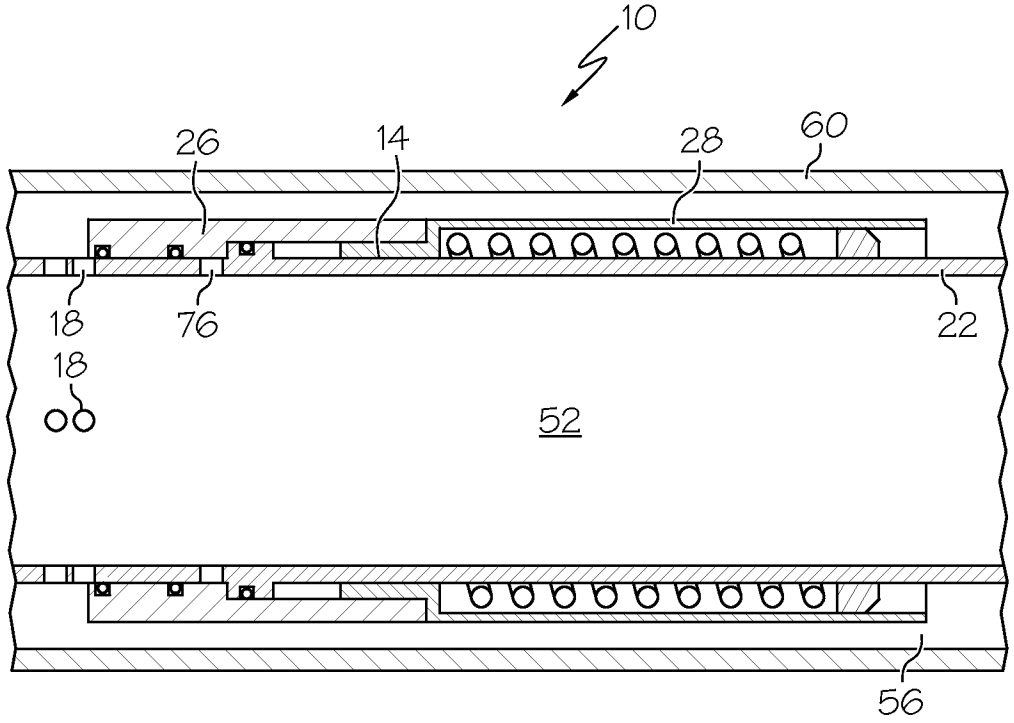
FIG. 2 depicts a cross sectional view of the valving device of FIG. 1 in an open position.

Referring to FIGS. 1 and 2, an embodiment of a valving device disclosed herein is illustrated generally at 10. The valving device 10 includes, a tubular 14 with at least one first port 18 (with a plurality of ports 18 being illustrated in this embodiment) through a wall 22 thereof. A sleeve 26 is slidably engaged with the tubular 14, between a first position, illustrated in FIG. 1, and a second position, illustrated in FIG. 2. The sleeve 26 is slidably sealable to the tubular 14 by a first seal 30, a second seal 34 and a third seal 38, illustrated herein as elastomeric o-rings, although alternate seals are contemplated such as metal seals, for example. The first seal 30 and the second seal 34 straddle the first ports 18 such that the sleeve 26 occludes flow through the first ports 18 when the sleeve 26 is in the first position, and permits flow through the first ports 18 when the sleeve 26 is in the second position.

The first seal 30 defines a first area 40, the second seal 34 defines a second area 44 and the third seal 38 defines a third area 48. The first area 40 and the second area 44 are equal such that pressure from an inside 52 of the tubular acting on the first and second areas 40, 44 through the first ports 18 does not generate a longitudinal urging force on the sleeve 26. The third area 48, however, is larger than the second area 44 such that pressure acting across these two areas 44, 48 does generate a longitudinal urging force on the sleeve 26. For example, increases in pressure radially outwardly of the tubular 14 and the sleeve 26, such as in an annular space 56 defined as radially outwardly of the tubular 14 and the sleeve 26 and radially inwardly of a structure 60 (such as a casing when the valving device 10 is employed in a downhole completion application for example) that is radially outwardly of the sleeve 26, causes an increase in an urging force on the sleeve 26. This increase in urging force is in a direction toward the second position.

Additionally, an optional biasing member 64, illustrated in this embodiment as a compression spring, is positioned between a ring 68 attached to the tubular 14, and a shoulder 72 of the sleeve 28 attached to the sleeve 26. The biasing member 64 thus biases the sleeve 26 toward the first position.

Also optional, is a second port 76 in the tubular 14 located between the second seal 34 and the third seal 38 that fluidically connects a chamber 80 defined between the second seal 34, the third seal 38, the sleeve 26 and an outer surface 84 of the tubular 14 with the inside 52. Since the second port 76 is optional, forces generated on the sleeve 26 from pressure within the chamber 80 varies depending upon whether the second port 76 is present or not. When the second port 76 is present, pressure from the inside 52 of the tubular 14 acts upon the difference in area of the second area 44 and the third area 48 in a direction that urges the sleeve 26 toward the first position. Alternately, when the second port 76 is not present, selected pressure within the chamber 80, such as ambient surface pressure when the device 10 is assembled at surface while at ambient pressure, act upon the difference in area to urge the sleeve 26 toward the first position.

The foregoing valving device 10 then permits an operator to move the sleeve 26 from the first position to the second position, and thereby open the first ports 18, by simply pressuring up the annular space 56. This increase in pressure acts across the difference between the third area 48 and the second area 44 thereby generating a force toward the second position, while the common values of the first area 40 and the second area 44 result in no net force on the sleeve 26 therefrom. As such, the operator can accurately predict the pressure required in the annular space 56 to open the valving device 10 since it must simply overcome friction, the biasing by the biasing member 64 if present and the pressure in the chamber 80 (be it the selected pressure or pressure from the inside 52, depending upon whether the second port 76 is present). Further, the operator can accurately predict at what pressure in the annular space 56 will result in closure of the valving device 10.

The valving device 10 can be employed as a gas lift valve, for example, when employed in a downhole completion wellbore. The operator can pressure up the annular space 56 with air (or other gas), from surface to cause the sleeve 26 to move to the second position, to thereby open the first ports 18 to a flow of air therethrough for mixing with fluids within the tubular 14 aiding in lifting of the fluids toward the surface. Injection of air into the tubular 14 can be halted by decreasing pressure of the air in the annular space 56 until the urging forces on the sleeve 26 return it to the first (or closed) position.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A valving device comprising:

a tubular with a port;

a sleeve slidably sealingly engaged with the tubular between a first position and a second position, the sleeve being configured to occlude the port when in the first position and uncover the port when in the second position, the valving device being configured such that a first pressure inside the tubular does not urge the sleeve toward the second position while a second pressure applied radially outwardly of the tubular and the sleeve urges the sleeve toward the second position, the second pressure exerting a force on the sleeve that is independent of a location of the sleeve relative to the first position and the second position, wherein the valving device is configured such that the first pressure inside the tubular urges the sleeve toward the first position, and wherein the second pressure is a fluid pressure; and a first seal, a second seal and a third seal that are slidably sealingly engaged between the sleeve and the tubular, wherein an opening between the second seal and the third seal fluidically connects a chamber to an inside of the tubular when the sleeve is in at least the first position.

2. The valving device of claim 1, further comprising a biasing member in operable communication with the sleeve configured to bias the sleeve toward the first position.

3. The valving device of claim 1, further comprising a chamber defined between the sleeve and the tubular configured such that pressure within the chamber urges the sleeve toward the first position.

4. The valving device of claim 3, wherein the chamber is in fluidic communication with an inside of the tubular.

5. The valving device of claim 1, wherein the first seal and the second seal longitudinally straddle the port.

6. The valving device of claim 1, wherein a first area defined by the first seal is substantially equal to a second area defined by the second seal.

7. The valving device of claim 6, wherein the second area is less than a third area defined by the third seal.

8. The valving device of claim 1, wherein at least one of the first seal, the second seal and the third seal are stationary relative to the tubular and movable relative to the sleeve.

9. The valving device of claim 1, wherein the seals are o-rings.

10. The valving device of claim 1, wherein the valving device is a gas lift valve.

11. A valve comprising:

a tubular with at least one port;

a sleeve slidably engaged with the tubular and movable between a first position and a second position; and a first seal, a second seal and a third seal each being sealable to both the tubular and the sleeve, the first seal and the second seal straddling the port thereby occluding flow through the at least one port when the sleeve is in the first position, the first seal not occluding flow through the at least one port when the sleeve is in the second position, the valve being configured to increase urging of the sleeve toward the second position in response to increases in an external pressure radially outwardly of the sleeve and the tubular and to not increase urging forces on the sleeve toward the second position in response to increases in an internal pressure within the tubular, the external pressure exerting a force on the sleeve that is independent of a location of the sleeve relative to the first position and the second position, the second seal and the third seal defining a chamber between the sleeve and an outer surface of the tubular, wherein the valve is further configured to increase urging of the sleeve toward the first position in response to increases in the internal pressure within the tubular, and wherein the tubular further comprises at least a second port, the at least a second port fluidly connected to the chamber when the sleeve is in at least the first position, and wherein the external pressure is a fluid pressure.

12. The valve of claim 11, further comprising a biasing member configured to bias the sleeve toward the first position.

* * * * *